US005911398A

United States Patent [19]

VanLandingham, Jr.

[11] Patent Number: 5,911,398

[45] Date of Patent: Jun. 15, 1999

[54] PORTABLE COPYHOLDER

[75] Inventor: A. Reneau VanLandingham, Jr., Knoxville, Tenn.

[73] Assignee: Newell Office Products Inc., Madison, Wis.

[21] Appl. No.: 08/733,278

[22] Filed: Oct. 17, 1996

[51] Int. Cl.[6] ..... A47B 19/00

[52] U.S. Cl. ..... 248/441.1; 40/124.07; 40/658; 248/918

[58] Field of Search ..... 248/441.1, 442.2, 248/450, 451, 453, 918, 473; 40/124.07, 738, 764, 124.19, 658; D19/86, 90, 91

[56] References Cited

U.S. PATENT DOCUMENTS

| | | | |
|---|---|---|---|
| D. 268,119 | 3/1983 | Evenson . | |
| D. 290,077 | 6/1987 | Hansen . | |
| D. 299,478 | 1/1989 | Klodt . | |
| D. 306,040 | 2/1990 | Evenson . | |
| D. 306,041 | 2/1990 | Evenson . | |
| D. 307,159 | 4/1990 | Foran et al. . | |
| D. 313,430 | 1/1991 | Evenson . | |
| D. 321,372 | 11/1991 | Evenson . | |
| D. 323,190 | 1/1992 | Evenson . | |
| 714,137 | 11/1902 | Branch . | |
| 812,634 | 2/1906 | Brown . | |
| 951,664 | 3/1910 | Swan . | |
| 2,248,396 | 7/1941 | Terry . | |
| 2,664,206 | 12/1953 | Beal . | |
| 2,799,968 | 7/1957 | Wythe . | |
| 2,940,598 | 6/1960 | Sundberg | 211/50 |
| 3,365,067 | 1/1968 | Miller et al. | 211/45 |
| 3,767,057 | 10/1973 | Holmes | 211/10 |
| 4,062,452 | 12/1977 | Bartholomew . | |
| 4,074,453 | 2/1978 | Knox . | |
| 4,083,456 | 4/1978 | Genn . | |
| 4,267,656 | 5/1981 | Solomon . | |
| 4,609,112 | 9/1986 | Belanger et al. | 211/45 |
| 4,712,760 | 12/1987 | Winter | 248/451 |
| 4,874,099 | 10/1989 | Arnott et al. | 211/50 |
| 4,934,648 | 6/1990 | Yueh | 248/442.2 |
| 5,046,626 | 9/1991 | Hansen . | |
| 5,201,428 | 4/1993 | Pasinski et al. | 211/50 |
| 5,295,590 | 3/1994 | Feer | 211/50 |
| 5,297,768 | 3/1994 | Denton | 248/442.2 |
| 5,366,197 | 11/1994 | Westland | 248/456 |
| 5,390,801 | 2/1995 | Hansen . | |
| 5,419,526 | 5/1995 | Chieng | 248/441.1 X |
| 5,505,421 | 4/1996 | Marthaler | 248/442.2 |
| 5,533,702 | 7/1996 | Koch | 248/442.2 |
| 5,775,663 | 7/1998 | Fitzsimmons et al. | 248/450 |

FOREIGN PATENT DOCUMENTS 857489 12/1960 United Kingdom .

OTHER PUBLICATIONS

Michelle Manisalco, "Concept To Reality At Warp Speed Phase IV", Oct., 1997, Injection Molding, pp. 66–68.

*Primary Examiner*—Derek J. Berger
*Attorney, Agent, or Firm*—Foley & Lardner

[57] ABSTRACT

A copyholder (10) includes a concave generally crescent-shaped rear support wall (20) and a forward support wall (32) that has another support edge (30). The support edge (30) substantially parallels and is spaced from the rear support wall (20) to form a curved sheet-receiving slot (18) that is generally concave with respect to the forward support wall (32). Rear support wall (20) is also tilted back away from the forward support wall (32) at a tilt angle (50) from vertical. When a sheet (16) is inserted into the sheet-receiving slot (18), the sheet (16) is bent along its vertical axis (42) and is tilted back away from the forward support wall (32) at the tilt angle (50). The tilt and the bend provide stability to the sheet (16) and prevent it from collapsing while it is held at a convenient viewing angle.

18 Claims, 2 Drawing Sheets

PORTABLE COPYHOLDER

TECHNICAL FIELD

The invention relates generally to copyholders and, in particular, to a portable copyholder that may be placed on any substantially planar surface. More specifically, the present invention relates to a compact, portable copyholder that is capable of holding sheets of paper at a convenient viewing angle when the sheets are received in a curved sheet-receiving slot and supported by a tilted support wall.

BACKGROUND ART

A copyholder is a device that holds a sheet or a plurality of sheets of paper at a convenient viewing angle for a typist while the typist works from the sheet of paper. As such, a copyholder allows the typist to maintain a comfortable working position while typing by eliminating the need for the typist to lean forward and look down on a sheet of paper that may be lying flat on a desk. Such copyholders can also increase the speed of the typist by displaying text adjacent the computer monitor so that the typist can quickly glance back and forth between the paper and the computer screen.

Typical devices for holding copy for viewing by a typist include a backing plate substantially the same size as the paper being held in combination with a clamp that holds the paper against the backing plate. While these devices are functional, their size renders them difficult to store while not in use. These devices may be either stand-alone units or be supported from items such as computer keyboards or monitors. In stand-alone units, a weighted base is typically used to support an adjustable stand and a full-size backing plate. Other units are designed to be clamped or permanently connected to a computer monitor. In both types of devices, the size and number of parts renders them relatively expensive to manufacture.

Such devices are also generally too cumbersome to travel with. As notebook computers have gained in popularity, the need for a portable copyholder that may be placed in a briefcase has also increased. Typical prior art devices are either too heavy or too large to be easily carried by traditional briefcases.

Devices that hold copy, or sheets of paper, are also useful in settings other than holding typing copy. For instance, a portable, stackable copyholder may also be used to hold recipes in a kitchen or hold menus in a restaurant. Another use for a compact copyholder is holding name cards at place settings on conference tables or dining tables.

Thus, the need exists for a portable, compact copyholder having an uncomplicated design that renders it relatively easy and inexpensive to manufacture.

DISCLOSURE OF THE INVENTION

It is thus an object of the present invention to provide a portable copyholder that may be used on any substantially flat surface.

It is another object of the present invention to provide a portable copyholder, as above, that has compact overall dimensions facilitating portability and ease of storage.

It is a further object of the present invention to provide a portable copyholder, as above, having a design that renders it relatively simple and inexpensive to manufacture.

It is yet another object of the present invention to provide a portable copyholder, as above, that effectively holds at least one copy and also holds a plurality of copies at a convenient viewing angle.

It is an additional object of the present invention to provide a portable copyholder, as above, that may be utilized to hold letter, legal, 11×17, A4 and foolscap sizes of paper in both horizontal and vertical orientations.

It is still a further object of the present invention to provide a portable copyholder, as above, that will hold a plurality of sheets of paper without tipping over.

These and other objects of the present invention, which will become apparent from the description to follow, are accomplished by the improvements hereinafter described and claimed.

In general, a portable copyholder includes a curved rear support wall and a forward support wall. The forward support wall has a support edge that substantially parallels and is spaced from the rear support wall to form a sheet-receiving slot therebetween. The rear support wall is tilted back away from the forward support wall such that a sheet of copy received in the sheet-receiving slot does not collapse.

A preferred exemplary portable copyholder is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

A copyholder according to the present invention is indicated generally in the accompanying drawings by the numeral 10. Copyholder 10 is designed to be positioned directly on a substantially planar surface 12 such as a desk or table top. Copyholder 10 may be fabricated from any of a variety of materials, but it has been found that fabricating copyholder 10 from plastic results in a light-weight device that is relatively easy and inexpensive to manufacture.

Figure 1:
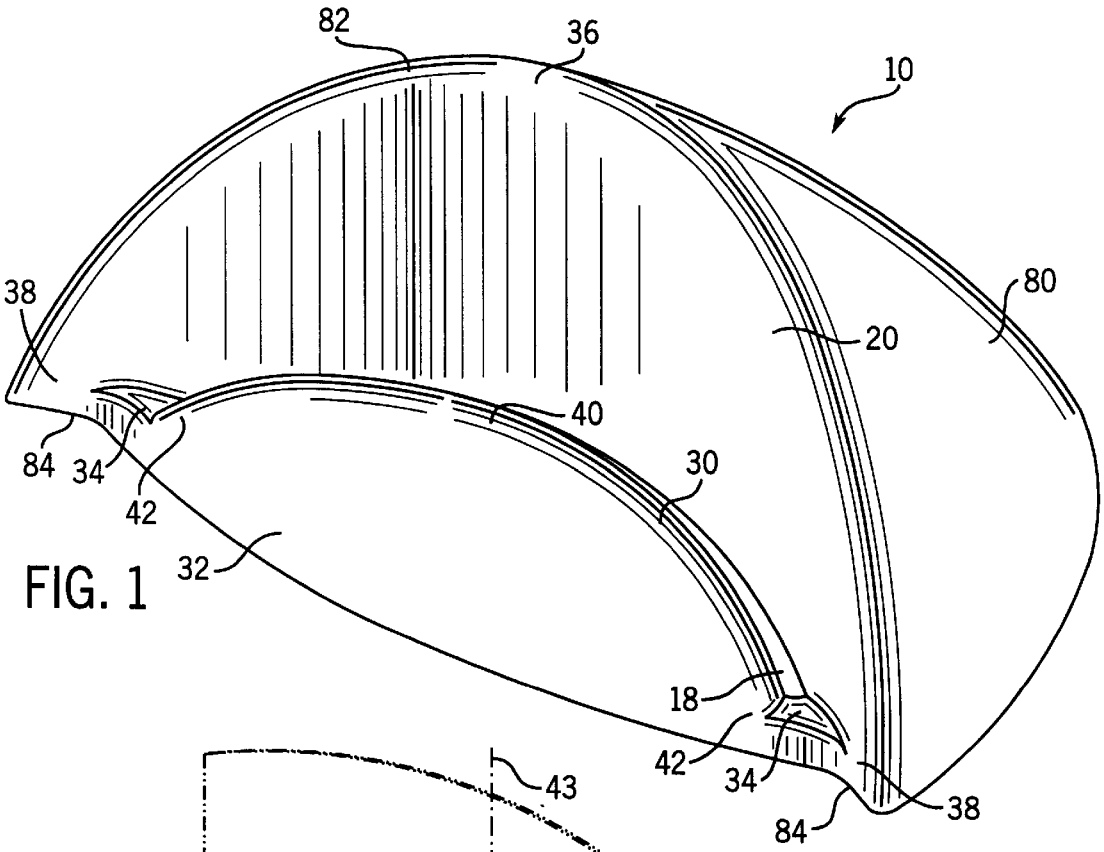
FIG. 1 is a perspective view of a portable copyholder made in accordance with the concepts of the present invention.
Figure 2:
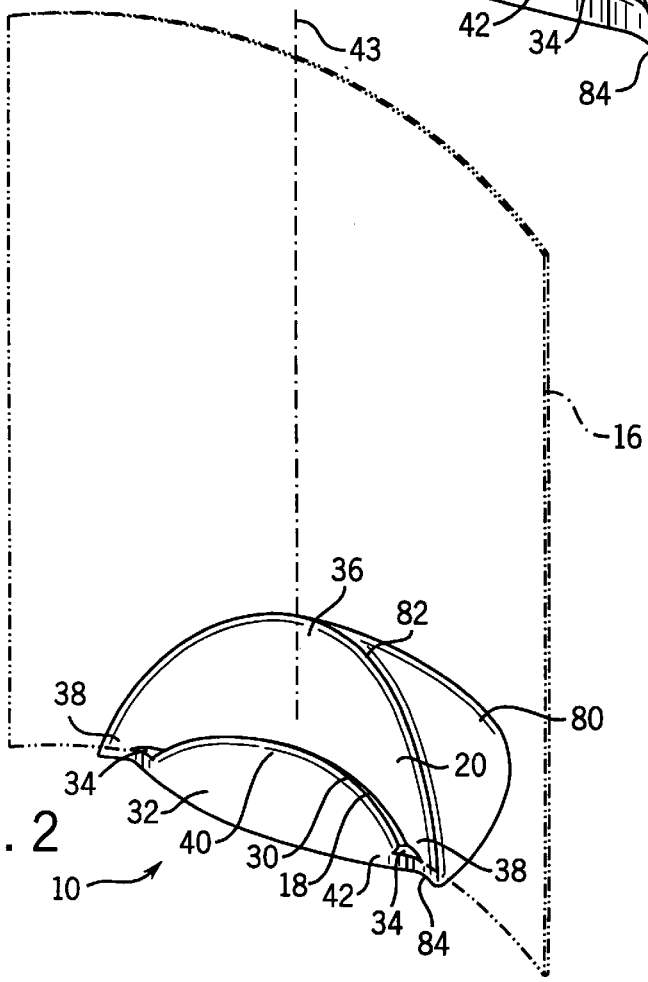
FIG. 2 is a perspective view of a portable copyholder made in accordance with the concepts of the present invention and shown with a single sheet of paper, depicted in phantom, being held by the copyholder.

As may be seen in FIG. 2, copyholder 10 is capable of holding a sheet 16 of paper or copy at a convenient viewing angle that renders the information on sheet 16 easy to read. Sheet 16 is held by copyholder 10 through the engagement of sheet 16 with a sheet-receiving slot 18 and a rear support wall 20. Slot 18 is formed between wall 20 and a support edge 30 at the top of a forward support wall 32. Edge 30 is substantially parallel to wall 20 to provide a slot 18 of substantially constant width so that a sheet 16 is not pinched between wall 20 and edge 30. Slot 18 can be made sufficiently wide so as to accommodate at least approximately 15 sheets of 20 pound weight paper. Obviously, slot 18 will hold fewer sheets of thicker paper and more sheets of lighter weight paper. A pair of lands 34 serve to support sheet 16 from below at the locations where forward support wall 32 connects to rear support wall 20.

Rear support wall 20 is generally crescent-shaped having an apex section, indicated generally by the numeral 36, and a pair of end sections, indicated generally by the numeral 38. Forward support wall 32 is convex in configuration and connects to rear support wall 20 at end sections 38 and also has an apex section, indicated generally by the numeral 40. Apex section 40 of forward support wall 32 is approximately one third of the height of apex section 36 of rear support wall 20. Such a configuration prevents a substantial portion of sheet 16 from being hidden from view while it is received in sheet-receiving slot 18. It has also been determined that the height of end sections 42 of forward support wall 32 only need to be approximately 5 percent of the height of apex section 36 of rear support wall 20. Again, the limited height of forward support wall 32 allows a substantial portion of sheet 16 to be viewed while in copyholder 10.

When sheet 16 is received in sheet-receiving slot 18, sheet 16 rests between rear support wall 20 and edge 30, and on lands 34. The curvature of both wall 20 and edge 30 define the curve of sheet-receiving slot 18 such that sheet 16 bends along its vertical axis 42 when it is received in sheet-receiving slot 18. This curve is preferably concave with respect to the forward support wall 32 and the typist who would use copyholder 10. Such a bend, or curve, in sheet 16 provides stability to sheet 16 allowing it to stand upright without collapsing. As more stability is desired, the radius of the curve may be decreased. It has been found that in conjunction with other aspects of the present invention, a curve having a radius, indicated by the numeral 42, of approximately 7 inches adequately serves to support sheets 16 of normal thickness paper size 11×17 inches and smaller in both horizontal and vertical orientations. As radius 42 is decreased, more stability is provided, but a sheet 16 may become more difficult to view.

Figure 4:
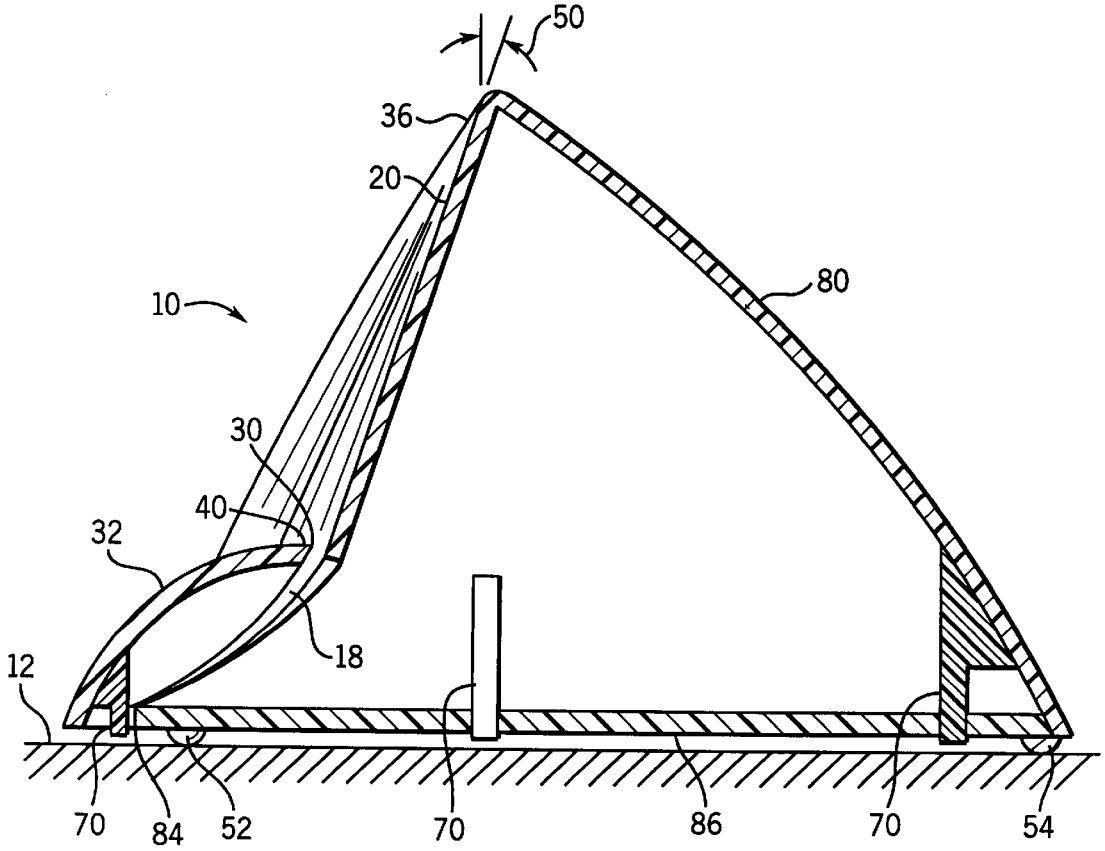
FIG. 4 is a sectional view of the portable copyholder taken substantially along line 4—4 of FIG. 3 and shown as positioned on a flat surface.

Another aspect of copyholder 10 that functions to maintain the upright, uncollapsed position of sheet 16 in copyholder 10 is the angle of rear support wall 20 with respect to vertical. As best seen in FIG. 4, wall 20 is tilted back, away from forward support wall 32. This tilt angle is indicated by numeral 50 in FIG. 4. It has been found for the purposes of the present invention that tilt angle 50 may be approximately 15°. Such a tilt angle 50 provides both a desirable viewing angle for a typist and provides additional stability to sheet 16 by preventing it from falling forward. Tilt angle 50 of rear support wall 20 combined with the curve of sheet-receiving slot 18 provides stability to sheet 16 and prevents it from collapsing under its own weight or in response to outside forces such as moving air or accidental contact.

Figure 3:
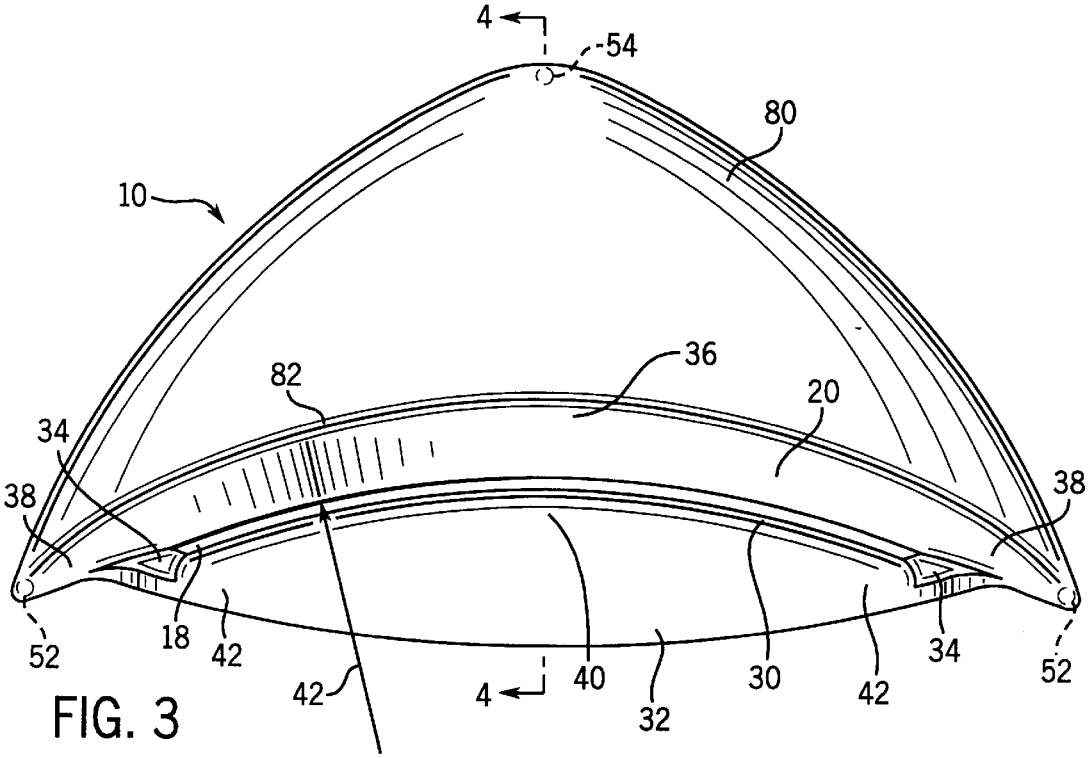
FIG. 3 is a top plan view of the portable copyholder.

Copyholder 10 may be provided with feet 52, 54 disposed in a tripod-like arrangement which further assists in stably holding a substantial number of sheets 16. As can be seen in FIGS. 3 and 4, two feet 52 are disposed at either side of copyholder 10 and a third foot 54 is disposed at a position relatively far behind rear support wall 20. It has been found that positioning rear foot 54 approximately 3 inches behind forward feet 52 provides a stable base for copyholder 10.

A plurality of connectors 70 are also provided to optionally connect a base plate 86 (See FIG. 4) to copyholder 10. The base plate may be used to add additional weight, and thus stability, to copyholder 10. Such additional weight also may allow copyholder 10 to be used as a paperweight. A convex cover member 80 serves to support connectors 70 and at least third foot 54. Cover member 80 may extend from the top edge 82 of rear support wall 20 and extends downwardly to the bottom edge 84 of rear support wall 20 to provide an even appearance.

It should thus be evident that a portable copyholder made in accordance with the concepts of the present invention not only provides a portable and storable copyholder for conveniently displaying at least one copy sheet, but also can be easily and inexpensively manufactured due to the relative simplicity of the design. The portable copyholder described herein thus accomplishes the objects of the present invention and otherwise substantially improves the copyholder art.

What is claimed is:

1. A copyholder comprising:

a curved rear support wall having a first lower edge and a first upper edge;

a forward support wall having a second lower edge and an upper arcuate support edge that substantially parallels and is spaced from said rear support wall to define a sheet-receiving slot therebetween, said upper arcuate support edge for supporting a sheet of copy;

wherein said rear support wall is tilted at an angle from said forward support wall; and wherein said upper arcuate support edge is proximate said first lower edge.

2. A copyholder according to claim 1 wherein said rear support wall is concave.

3. A copyholder according to claim 1 wherein said sheet-receiving slot has a radius of approximately seven inches.

4. A copyholder according to claim 1 further comprising a cover member extending from said first upper edge and a plurality of feet extending from at least one of said cover member and said forward support wall, the plurality of feet being disposed in a tripod-like arrangement.

5. A copyholder according to claim 4 wherein one of said feet is disposed behind said rear support wall.

6. A copyholder according to claim 5 wherein said foot disposed behind said rear support wall is disposed approximately three inches behind said wall.

7. A copyholder according to claim 4 further comprising a plurality of connectors extending from at least one of said cover member and said forward support wall, said connectors for releasably engaging a base plate.

8. A copyholder according to claim 1 wherein said rear support wall is tilted back approximately fifteen degrees from vertical.

9. A copyholder according to claim 1 further comprising a pair of lands positioned at either end of said sheet-receiving slot wherein said lands are adapted to support a sheet of paper received in said sheet-receiving slot.

10. A copyholder according to claim 1 wherein said forward support wall has an apex section and two end sections, said apex section being approximately one third of the height of said rear support wall and said end sections being approximately five percent of the height of said rear support wall.

11. A copyholder comprising:

a concave rear support wall including an arcuate top edge and a bottom edge, the rear support wall being tilted back at an angle from vertical;

a forward support wall having an upper arcuate edge for supporting said copy;

wherein said forward support wall is attached to said rear support wall such that the upper arcuate edge is substantially parallel to and a predetermined distance from said rear support wall; and wherein said upper arcuate edge is proximate said bottom edge.

12. A copyholder according to claim 11 wherein said rear support wall and said forward support wall are of unitary construction.

13. A copyholder according to claim 11 wherein said rear support wall and said forward support wall define a sheet receiving slot, said copyholder further comprising a pair of lands positioned at either end of said sheet receiving slot.

14. A copyholder according to claim 11 further comprising a cover member extending from said arcuate top edge, and a plurality of connectors extending from at least one of said cover member and said forward support wall, said connectors for releasably engaging a base plate.

15. A copyholder to be placed on a substantially flat surface comprising:

a concave rear support wall having a first lower edge and a first upper arcuate edge;

a forward support wall having a second lower edge and a second upper arcuate support edge for engaging said copy;

wherein said forward support wall is attached to said rear support wall such that the second upper arcuate support edge is substantially parallel to and spaced apart from said rear support wall; and wherein said second upper arcuate support edge is proximate said first lower edge.

16. A copyholder according to claim 15 wherein said first and second lower edges are adapted to partially support said copyholder on said substantially flat surface.

17. A copyholder according to claim 15 further comprising a cover member extending from said first upper arcuate edge and a plurality of feet extending from at least one of said cover member and said forward support wall, the plurality of feet being disposed in a tripod-like arrangement.

18. A copyholder according to claim 17 further comprising a plurality of connectors extending from at least one of said cover member and said forward support wall, said connectors for releasably engaging a base plate.

* * * * *